United States Patent [19]

Yoneyama et al.

[11] 4,229,524

[45] Oct. 21, 1980

[54] PHOTOGRAPHIC LIGHT SENSITIVE MATERIAL WITH ANTISTATIC PROPERTY

[75] Inventors: Masakazu Yoneyama; Shinzo Kishimoto, both of Minami-ashigara, Japan

[73] Assignee: Fuji Photo Film Co., Ltd., Minami-ashigara, Japan

[21] Appl. No.: 45,482

[22] Filed: Jun. 4, 1979

[30] Foreign Application Priority Data

Jun. 2, 1978 [JP] Japan ..... 53-66516

[51] Int. Cl.[2] ..... G03C 1/78; G03C 1/96

[52] U.S. Cl. ..... 430/536; 430/527; 430/533; 430/537; 430/631; 430/635

[58] Field of Search ..... 430/527, 529, 531, 533, 430/536, 537, 631–633, 634–638

[56] References Cited

U.S. PATENT DOCUMENTS

| | | | |
|---|---|---|---|
| 3,753,716 | 8/1973 | Ishihara et al. | 430/527 |
| 3,850,640 | 11/1974 | Babbitt et al. | 430/531 |
| 3,850,642 | 11/1974 | Bailey, Jr. et al. | 430/531 |
| 3,884,699 | 5/1975 | Cavallo et al. | 430/527 |
| 3,888,678 | 6/1978 | Bailey, Jr. et al. | 430/531 |

*Primary Examiner*—Edward C. Kimlin

*Assistant Examiner*—Alfonso T. Suro Pico

*Attorney, Agent, or Firm*—Sughrue, Rothwell, Mion, Zinn and Macpeak

[57] ABSTRACT

A photographic light sensitive material which contains, in at least one layer, a copolymer having a repeating unit represented by the following general formula (I):

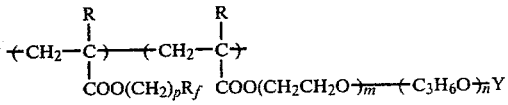

(I)

wherein $R_f$ represents a perfluoroalkyl group having 2 to 12 carbon atoms which may contain one hydrogen atom at the ω-position or a perfluoroalkenyl group; R represents a hydrogen atom or a methyl group; p represents an integer of 1 to 5; m represents an integer of 5 to 50; n represents zero or an integer of 1 to 20; and Y represents a hydrogen atom, an alkyl group having 1 to 24 carbon atoms, an alkenyl group, a phenyl group, an alkylphenyl group or one of the groups represented by $R_f$; whereby antistatic property (even under low humidity) and adhesion resisting property are improved without adversely affecting photographic characteristics.

9 Claims, No Drawings

PHOTOGRAPHIC LIGHT SENSITIVE MATERIAL WITH ANTISTATIC PROPERTY

BACKGROUND OF THE INVENTION

1. Field of the Invention

The present invention relates to a silver halide photographic light sensitive material having improved antistatic property and particularly, to a photographic light sensitive material having both improved antistatic and adhesion resisting properties without adversely affecting photographic characteristics.

2. Description of the Prior Art

Since a photographic light sensitive material comprises in general, an electrically insulating support and photographic layers, accumulation of electrostatic charge on the photographic material results from contact friction between the surface of the photosensitive material and the surface of the same or a different material, and from separation of materials superposed on one another, each of which takes place frequently in manufacturing the photosensitive materials and in the course of the using them. The accumulated electrostatic charge causes various problems. The most serious problem is the appearance of dotted spots or branchy or feathered streaks on a photographic film upon development processing, caused by exposure of the light sensitive emulsion layers by sparks generated by discharge of accumulated electrostatic charge before development. Such spots and streaks are so-called static marks and they markedly impair or completely spoil the value of the photographic film. For instance, on the occasion that the static mark makes its appearance on an X-ray film for medical or industrial purpose, there is a danger of wrong diagnosis. Static marks are very troublesome because they can not be ascertained until development processing is complete. Moreover, the accumulated electrostatic charge is responsible for the induction of secondary problems. The surface of a photographic film is susceptible to adhesion of dust and the uniform coating of photographic layers becomes difficult.

As described above, such electrostatic charge is often accumulated during the manufacture and the use of the photographic materials. More specifically, in the process of manufacturing them, the accumulation of electrostatic charge results from, for instance, contact friction induced between a photographic film and a roller used, contact friction arising from the winding of a photographic film, separation of the support surface from the surface of the topmost emulsion layer upon the rewinding of the photographic film and so on. When using the finished articles, the accumulation of electrostatic charge is caused when the back surface of a photographic film contacts the surface of the topmost emulsion layer during rewinding of a wound film with the other take up shaft, or the contact of an X-ray film with instrument parts or a fluorescent intensifying screen and separation of the former from the latter in an automatic X-ray photograph-taking apparatus. In addition, electrostatic charge arises from contact with the wrapping material. The static marks induced on the photographic light sensitive material by accumulated electrostatic charges through the above-described motions are revealed more plainly and increase in number with an increase in the sensitivity of the photographic light sensitive material and the processing speed. Particularly, photographic light sensitive materials have recently been confronted with many instances in which they are processed under drastic conditions providing high sensitivity, high-speed coating, high-speed photographing, high-speed automatic processing and so on. Under these circumstances, the generation of static marks is more frequent.

The best way to avoid the problems resulting from the accumulation of electrostatic charge is to enhance the electric conductivity of the photographic film and thereby quickly disperse the electrostatic charge induced thereon and discharge the electrostatic charge. Such being the case, methods for improving the electric conductivities of the support, various surface layers of photographic light sensitive materials have been proposed, and various hydroscopic substances and water soluble inorganic salts, certain surface active agents, polymers and the like have been tried for this purpose. Examples of the substances which have been used to improve electric conductivity include polymers such as disclosed in U.S. Pat. Nos. 2,882,157; 2,972,535; 3,062,785; 3,262,807; 3,514,291; 3,615,531; 3,753,716; 3,938,999, etc.; surface active agents such as disclosed in U.S. Pat. Nos. 2,982,651; 3,428,456; 3,457,076; 3,454,625; 3,552,972; 3,655,387, etc.; zinc oxide, semiconductors, colloidal silica, etc as disclosed in U.S. Pat. Nos. 3,062,700; 3,245,833 and 3,525,621. However, many of these substances are highly selective in their effectivenesses. Namely certain substances exhibit sufficient antistatic effect only when used in conjunction with certain supports, photographic emulsions and other photographic elements, but are entirely useless when applied to different supports and photographic elements and, further, under some circumstances they adversely affect the photographic properties which make matters even worse.

In particular, much difficulty has been encounted attempting to provide antistatic property to hydrophilic colloidal layers, and even if the antistatic property has been improved to an extent, it was often been attended by undesirable side effects such as an insufficient reduction in surface resistance under low humidity, adhesion problems between the same photographic light sensitive materials or between a photographic light sensitive material and another material under conditions of high temperature and humidity, etc.

On the other hand, there have been instances when despite the excellent antistatic effect upon the hydrophillic colloidal layers, certain substances could not be used because they adversely affected the photographic characteristics of the photographic emulsion layers, such as sensitivity, fog, graininess, sharpness, etc. For instance although polyethylene oxide series compounds have been known to possess the antistatic effect, they have frequently yielded undesirable effects on the photographic characteristics such as increase in fog, desensitization, deterioration of graininess and so on. Particularly, it has been difficult to establish such techniques as to give effectively the antistatic property to sensitive materials of the kind which have supports having on the both sides thereof coated photographic emulsion layers, such as direct radiographic sensitive materials for medical use. As described above, the application of conventional antistatic agents to photographic light sensitive materials has been very difficult and that, in many cases such agents have been restricted to only few uses.

SUMMARY OF THE INVENTION

Therefore, an object of the present invention is to provide a photographic light sensitive material having antistatic property.

Another object of the present invention is to provide a high-speed photographic light sensitive material having improved antistatic property and possessing low surface resistance and reduced charging capacity even under low humidity (25% RH).

A further object of the present invention is to provide an effective means of protecting a photographic light sensitive material from accumulating electric charge without adversely affecting photographic characteristics (e.g., sensitivity, fog, graininess, sharpness, etc.).

Still another object of the present invention is to provide a photographic light sensitive material having improved adhesion resisting property.

The above-described objects are attained by incorporating into at least one layer of a photographic material a copolymer containing as a repeating unit a combination of a polyethylene oxide chain-containing acrylic or methacrylic acid ester monomer and a fluorinated alkyl group-containing acrylic or methacrylic acid ester monomer, which is represented by the following general formula (I):

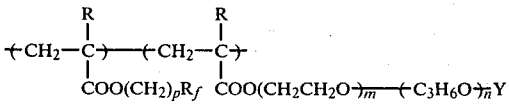

(I)

wherein $R_f$ represents a perfluoroalkyl group having 2 to 12 carbon atoms which may contain one hydrogen atom at the ω-position and preferably 4 to 8 carbon atoms or a perfluoroalkenyl group having 2 to 12 carbon atoms, preferably 4 to 8 carbon atoms; R represents a hydrogen atom or a methyl group; p represents an integer of 1 to 5; m represents an integer of 5 to 50 and preferably, 5 to 20; n represents zero or an integer of 1 to 20 and preferably 1 to 10; Y represents a hydrogen atom, an alkyl group having 1 to 24 carbon atoms, an alkenyl group preferably having 18 carbon atoms, a phenyl group, an alkylphenyl group (the alkyl moiety of which has preferably 4 to 18 carbon atoms) or one of the groups represented by $R_f$.

DETAILED DESCRIPTION OF THE INVENTION

Examples of $R_f$ in the above-described general formula (I) include $CF_2CF_3$, $(CF_2)_3CF_3$, $(CF_2)_5CF_3$, $(CF_2)_7CF_3$, $(CF_2)_9—CF_3$, $(CF_2)_6CF_2H$, $(CF_3)_2C{=}C—CF_2CF_3$ and so on.

Examples of Y in the formula (I) include a hydrogen atom, straight or branched chain alkyl groups such as methyl, ethyl, butyl, decyl, dodecyl, tetradecyl, octadecyl and the like; alkenyl groups such as oleyl and the like; alkylphenyl groups such as butylphenyl, nonylphenyl and the like; etc.

The molecular weight of the copolymer of the present invention may be more than 3,000 and preferably, ranges from 10,000 to 100,000.

The copolymers employed in the present invention contain the above-described comonomers as repeating units. A third comonomer optionally may be present in the copolymers. Specific exmaples of the third comonomer include alkyl acrylates (the alkyl moieties of which have 1 to 3 carbon atoms), alkali metal salts of acrylic acid (e.g., the sodium salt and potassium salt), styrenes, etc.

Copolymers preferably employed in the present invention are binary copolymers represented by the following formula (II):

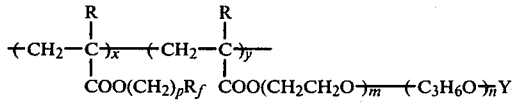

(II)

wherein x:y is about =70:30 to 10:90, preferably about 50:50 to 20:80 in mol%.

Specific examples of representative copolymers employed in the present invention are illustrated below:

Compound 1

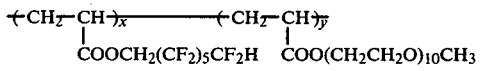

x:y = 40:60

Compound 2

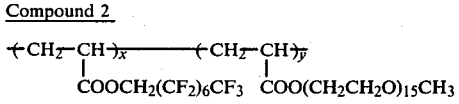

x:y = 50:50

Compound 3

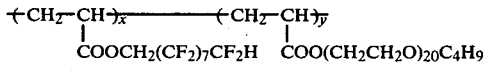

x:y = 60:40

Compound 4

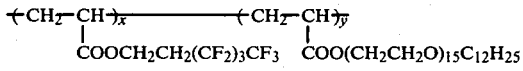

x:y = 50:50

Compound 5

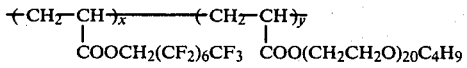

x:y = 40:60

Compound 6

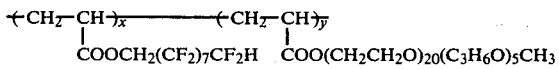

x:y = 50:50

Compound 7

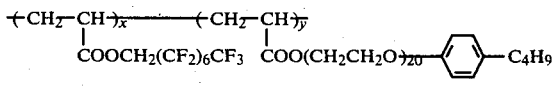

x:y = 50:50

Compound 8

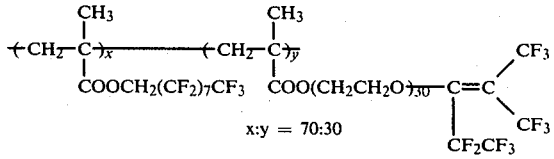

x:y = 70:30

Compound 9

-continued

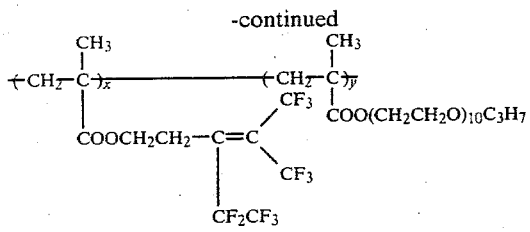

x:y = 40:60

The copolymer used in the present invention may be present in at least one layer of a photographic light sensitive material other than a silver halide light sensitive emulsion layer, such as a surface protecting layer, a backing layer, an interlayer, a subbing layer and so on. In this regard it is noted that the copolymers used in the present invention are used for their antistatic and adhesion resisting property throughout the manufacture of the light-sensitive material such that they may be incorporated into layers which are at the surface of the light sensitive material at some intermediate stage of production (e.g., a subbing layer) but are not the outermost layers of the finished product. When the backing layer is made up of two layers, copolymers used in the present invention may be added to either layer or they can be also employed in the form of overcoat provided on the surface protecting layer. In order to make it possible for the copolymers to exhibit their effects to the greatest extent, they are preferably added to the outermost layers of a photographic light sensitive material, namely the surface protecting layer and the backing layer thereof.

The compounds represented by the general formula (I) are characterized by the presence of at least one fluorocarbon group in the molecule and thereby, the surface activity is increased. In addition, it can be appreciated that due to their high molecular weight and the fluorocarbon groups the compounds of the present invention are easily fixed in the layer in which they are incorporated, such as a surface protecting layer or a backing layer of a photographic light sensitive material and, consequently, it becomes difficult for them to diffuse into or to transfer onto other layers. The ability to fix the compounds in the layer in which they are incorporated seems to be a reason for the decrease in the influence of the compounds upon the photographic characteristics of the photosensitive material and the presence of fluorocarbon groups in the surface layer seems to contribute to the prevention of adhesion.

The compounds represented by the general formula (I) used in the present invention can be synthesized by copolymerization of an perfluoroalkyl acrylate monomer prepared by reacting acrylic acid with an perfluoroalcohol, with a polyoxyethylenealkyl acrylate obtained by reacting acrylic acid with a polyoxyethylenealkyl alcohol in manners well known in the art.

Some of the copolymers employable in the present invention are on the market such as Fluorad FC-430, Fluorad FC-431 (products of 3 M Co., Ltd.), Megafac F-171, Megafac F-173 (products of Dai-Nippon Ink & Chemicals, Inc.) and so on.

To introduce the copolymers into a photographic light sensitive material, they are dissolved in water or an organic solvent such as methanol, isopropanol, acetone or the like or in a mixed solvent thereof and the resulting solution is added to the coating composition for the surface protecting or back layer. The coating solution obtained is coated using conventional techniques, for example, dip coating, air knife coating, extrusion coating using a hopper as disclosed in U.S. Pat. No. 2,681,294; and techniques of coating simultaneously two or more layers as disclosed in U.S. Pat. Nos. 3,508,947; 2,941,898; 3,526,528, etc. Another method is to soak the surface protecting layer or the back layer in a static charge preventing solution containing the copolymer of the present invention. Moreover, the static charge preventing solution containing the copolymer of the present invention may be optionally, coated on the protecting layer.

A preferred coating amount for the copolymer per square meter of the photographic film ranges from about 0.005 g/m$^2$ to 20 g/m$^2$, particularly from about 0.01 g/m$^2$ to 0.5 g/m$^2$. However, the above-described range varies with the type of photographic film support used, the composition of the photographic light sensitive material used, the form thereof, and the coating technique.

Specific examples of materials which may be used as the support of a photographic light sensitive material include a cellulose nitrate film, a cellulose acetate film, a cellulose acetate butyrate film, a cellulose acetate isopropionate film, a polystyrene film, a polyethylene terephthalate film, a polycarbonate film, laminates thereof, etc. In addition, baryta paper and paper coated or laminated with an $\alpha$-olefin polymer, particularly polymers prepared from $\alpha$-olefin(s) having 2 to 10 carbon atoms, such as polyethylene, polypropylene, ethylenebutene copolymer or the like, can also be used as the support. The support may be transparent or opaque. Suitable supports are selected depending upon the end-use of the photo-sensitive material. In the case of transparent supports, not only colorless transparent materials but also those which are colored with dyes or pigments can be employed.

On the occasion that the surface adhesion force between a support and a photographic emulsion layer is insufficient, a layer adherent to both the support and the emulsion layer may be sandwiched between them as a subbing layer in a conventional manner. In addition, to further improve the adhesiveness of the support surface, the support may be subjected to conventional pretreatments such as corona discharge, irradiation with ultraviolet rays, a flame treatment and so on.

Each of the photographic layers can contain binders set forth below in the photographic light sensitive material of the present invention. Specific examples of such binders include natural hydrophilic colloids such as proteins (e.g., gelatin, colloidal albumin, casein and the like), cellulose compounds (e.g., carboxymethyl cellulose, hydroxyethyl cellulose and the like) and sugar derivatives (e.g., agar, sodium alginate, starch derivatives and the like); and synthetic hydrophilic colloids such as polyvinyl alcohol, poly-N-vinyl pyrrolidone, acrylic acid copolymers, polyacrylamide and derivatives thereof, partially dehydrolyzed products thereof and so on. The above-described colloids may optionally be used in combination.

Of these hydrophilic colloids, gelatins are most frequently employed. The term gelatins refers to the so-called lime-processed gelatin, acid-processed gelatin and enzyme-processed gelatin. Further, part or all of the binding component occupied by gelatin may be replaced by synthetic macromolecular substances. Furthermore, so-called gelatin derivatives; namely gelatins modified by treating the functional groups contained in a gelatin molecule, such as amino, imino, hydroxy and carboxyl groups, with a reagent having at least one group capable of reacting with such groups, or graft polymers prepared by bonding the molecular chains of macromolecular substances to the reactive sites of gelatins, may also be employed in the place of gelatin.

The silver halide emulsion of a photographic light sensitive material employed in the present invention is, in general, prepared by mixing a water soluble silver salt solution (e.g., silver nitrate) and a water soluble halide solution (e.g., potassium bromide) in the presence of the solution of a water soluble high polymer such as gelatin. As such a silver halide, not only silver chloride or silver bromide but also a mixed silver halide such as silver chlorobromide, silver iodobromide, silver chloroiodobromide or the like can be used. The grains of such a silver halide can be produced in a known manner. Needless to say, the grains produced using the so-called single jet method, double jet method, controlled double jet method or the like are also useful in the present invention. These photographic emulsions can be prepared using known conventional processes, for example, an ammonia process, a neutral process, an acid process and so on, as described in T. H. James & C. E. K. Mees, *The Theory of the Photographic process,* 3rd Ed., MacMillian, New York (1966) and P. Glafkides, *Chemie Photographique,* Paul Montel, Paris (1957). The sensitivity of the thus produced silver halide grains can be enhanced without coarsening the grains, by subjecting the grains to a heat treatment in the presence of chemical sensitizers (e.g., sodium thiosulfate, N,N,N'-trimethylthiourea, thiocyanate complex salts and thiosulfate complex salts of monovalent gold, stannous chloride, hexamethylene tetramine and so on).

The photographic emulsion can be subjected, if desired, to a spectral sensitization or a super-sensitization using polymethine sensitizing dyes (e.g., cyanine, merocyanine, carbocyanine, etc.) alone or in combination, or a combination of such a cyanine dye and a styryl dye and the like.

To the photographic emulsion of a photographic light sensitive material employed in the present invention, various compounds can be added to prevent a reduction in sensitivty or prevent fog from occurring during manufacture of the sensitive material, during the storage of the finished sensitive material or in the course of processings thereof. A wide variety of compounds, such as a number of heterocyclic compounds such as 4-hydroxy-6-methyl-1,3,3a,7-tetraazaindene-3-methylbenzothiazole, 1-phenyl-5-mercaptotetrazole and so on, mercury-containing compounds, mercapto compounds, metallic salts and so on, have been used for a long time. Specific examples of suitable compounds for the above-described purposes are described in detail in T. H. James & C. E. K. Mees, *The Theory of the Photographic Process,* 3rd Ed., MacMillan, New York (1966), in which original literature regarding such compounds is also set forth.

On the occasion that the silver halide photographic emulsion is employed as a color photographic light sensitive material, couplers may be incorporated into the silver halide photographic emulsion. As such couplers, four equivalent type or two equivalent type diketomethylene series yellow couplers, specific examples of which are described, for example, in U.S. Pat. Nos. 3,277,157; 3,408,194 and 3,551,155; and Japanese Patent Applications (OPI) Nos. 26133/'72 and 66836/'73; four equivalent type or two equivalent type pyrazolone series and indazolone series magenta couplers, specific examples of which are described in, for example, U.S. Pat. Nos. 2,600,788; 3,214,437 and 3,476,560; and Japanese Patent Application (OPI) No. 26133/'72; and α-naphtholic cyan couplers and phenolic cyan couplers, specific examples of which are described in, for example, U.S. Pat. Nos. 2,474,293; 3,311,476 and 3,481,741; can be employed. In addition, couplers of the kind which can release development inhibitors, as described in U.S. Pat. Nos. 3,227,554; 3,253,924; 3,379,529; 3,617,291 and 3,770,436; etc, can also be employed herein.

The silver halide emulsion layers and other hydrophilic colloidal layers contained in the photographic light sensitive material of the present invention may receive a hardening treatment using various kinds of organic or inorganic hardeners (individually or in combination). Specific examples of such hardeners include aldehyde series compounds such as mucochloric acid, formaldehyde, trimethylolmelamine, glyoxal, 2,3-dihydroxy-1,4-dioxane, 2,3-dihydroxy-5-methyl-1,4-dioxane, succinaldehyde, glutaraldehyde and the like, active vinyl compounds such as divinyl sulfone, methylenebismaleinimide, 1,3,5-triacryloyl-hexahydro-s-triazine, 1,3,5-trivinylsulfonylhexahydro-s-triazinebis(vinylsulfonylmethyl) ether, 1,3-bis(vinylsulfonylmethyl) propanol-2, bis(α-vinylsulfonylacetoamide)ethane and the like; active halogen compounds such as 2,4-dichloro-6-hydroxy-s-triazine sodium salt, 2,4-dichloro-6-methoxy-s-triazine and so on; ethyleneimine compounds such as 2,4,6-triethyleneimino-s-triazine and the like; and so on.

Surface active agents may be added individually or in combination to the photographic layers of the present invention. These agents are employed as coating aids to facilitate the coating of such layers and further, they may be occasionally applied thereto for other purposes, for example, facilitation of emulsification dispersion, sensitization, improvements in other photographic characteristics, adjustment of charging series and so on.

These surface active agents are divided into five groups: namely a first group consisting of natural surface active agents with specific examples including saponin, etc. a second group consisting of nonionic surface active agents of alkylene oxides, glycerine, glycidol, etc.; a third group consisting of cationic surface active agents with specific examples including higher alkylamines, quaternary ammonium salts, pyridine and other heterocyclic compounds, phosphoniums and sulfoniums, etc.; a fourth group consisting of anionic surface active agents containing acidic groups such as carboxylic, sulfonic, phosphoric, sulfato, phosphato, etc.; and a fifth group consisting of amphoteric surface active agents, with specific examples including amino acids, aminosulfonic acids, sulfuric acid esters or phosphoric acid esters of aminoalcohols etc.

Representative specific examples of surface active agents which are practical are described in Ryohei Oda, et al, *Synthesis and Applications of Surface Active Agents,* Maki Shoten (1964), A. M. Schwarts et al, *Surface Active Agents,* Interscience Publications Incorporated (1958) and J. P. Sisley, et al, *Encyclopedia of Surface Active Agents,* Chemical Publishing Company (1964), as well as U.S. Pat. Nos. 2,271,623; 2,240,472; 2,288,226; 2,739,891; 3,068,101; 3,158,484; 3,201,253; 3,210,191; 3,294,540; 3,415,649; 3,441,413; 3,442,654; 3,475,174; 3,545,974; 3,666,478 and 3,507,660: and British Pat. No. 1,198,450.

Moreover, in the present invention, a lubricating composition such as denatured silicone oil, as disclosed in, for example, U.S. Pat. Nos. 3,079,837; 3,080,317; 3,545,970 and 3,294,537; and Japanese Patent Application (OPI) No. 129520/'77, can be incorporated into the photographic layer.

The photographic light sensitive material of the present invention can contain, in the photographic layers, polymer latexes as disclosed in, for example, U.S. Pat. Nos. 3,411,911 and 3,411,912; and Japanese Patent Publication No. 5331/'70; and matting agents such as silica, strontium sulfate, barium sulate, polymethylmethacrylate, etc.

In accordance with the present invention, the problem resulting from static charge which the photographic light sensitive material encountered during the production and/or the use are reduced. The occurrence of static marks resulting from contact friction between the emulsion layer and the backing layer of a photographic light sensitive material, the contact friction between one emulsion layer and another emulsion layer, and the contact friction between a photographic light sensitive material and for example, a rubber, a metal, a plastic, a fluorescent intensifying screen and so on can be markedly decreased. The most striking aspect of the present invention is that when applied to the outermost layer of the photographic light sensitive material, the compound of the present invention reduces the surface resistivity to a great extent and hardly influences the photographic characteristics as illustrated in the following Examples.

The present invention will now be illustrated in greater detail by reference to the following examples. However, the present invention should not be construed as being limited to these examples. Unless otherwise indicated all parts, percents, ratios, etc. herein are by weight.

EXAMPLE 1

On the both sides of a polyethylene terephthalate film support, were coated the emulsion layers and the protecting layers described below in order and dried in a conventional manner to prepare a photographic light sensitive material.

(1) An emulsion layer having a thickness of about 5μ and containing 5 g/m$^2$ of silver of silver iodo-bromide grains (consisting of 1.5 mol% of silver iodide and 98.5 mol% of silver bromide), 2.5 g/m$^2$ of gelatin, 0.02 g/m$^2$ (corresponding to 0.8 g per 100 g of gelatin) of chrome alum as a hardener, and 0.025 g/m$^2$ (corresponding to 0.5 g per 100 g of silver) of 1-phenyl-5-mercaptotetrazole as an antifoggant.

(2) A protecting layer having a thickness of about 1μ and containing as a binder 1.7 g/m$^2$ of gelatin and 0.3 g/m$^2$ of potassium polystyrenesulfonate (having an average molecular weight of about 70,000), and as a coating aid 7 mg/m$^2$ of N-oleoyl-N-methyltaurine sodium salt.

The thus obtained photographic light sensitive material was designated Sample (1). Samples (2) to (4) were prepared in the same manner as described above except that the protecting layers additionally contained 55 mg/m$^2$ of Compounds 1, 2 and 9 of the present invention, respectively. For the purpose of comparison, Samples (5) to (8) were prepared in the same manner as Sample (1) except that the protecting layers further contained 55 mg/m$^2$ of saponin, saccharose monolauric acid ester, polyoxyethylene nonylphenyl ether (n=10), polyoxyethylene lauryl ether (n=20), respectively, in addition to the above-described composition.

Each of these samples was examined for specific resistance and static marks in the following manner.

(a) Measurement of specific resistance at the surface

Each of samples was allowed to stand for 2 hours at 25% RH and 25° C. Then, under the similarly controlled conditions placed between a pair of brass electrodes spaced 0.14 cm apart and 10 cm long (wherein the part to come into contact with the sample was made of stainless steel), and the specific resistance over 1 minute at the surface of the sample was measured using an electrometer (TR-8651, produced by Takeda Riken Co., Ltd.).

(b) Measurement of static marks

Each of the optically unexposed samples under the same humidity conditions as described above, was placed in a dark room and rubbed successively with a rubber roller and a nylon roller. Next, it was developed with a developing solution described hereinafter, fixed and washed and examined for static marks.

Evaluation of the degree of the occurrence of static marks was made qualitatively according to the following criterion:

| Rank | Feature |
|---|---|
| A | Observed no static mark |
| B | Observed static mark to a small extent |
| C | Observed static mark to a considerable extent |
| D | Observed static mark almost all over the surface |

(c) Measurement of charging capacity

Two pieces of each sample film (2 cm wide and 11 cm long) were stuck to each other using a double-faced adhesive tape so that both protecting layers faced outside, and allowed to stand for 2 hours at 25% RH and 25° C. Then, it was allowed to pass through the space between two rotating white rubber rolls, and placed in a Faraday cage. The charging capacity of the thus obtained sample (unit:volt) was measured using an electrometer.

Moreover, two pieces of each sample film (4 square centimeters) were allowed to stand for 2 days at 90% RH and 40° C. and then the protecting layers thereof were allowed to stand in face-to-face contact with each other. Thereto, a load weighing 800 grams was applied. It was kept for one day at 40° C., 90% RH. Then, one piece was stripped from the other piece. The area of the portion of one sample film remaining on the other sample film was observed and thereby, the extent of adhesion resisting property was evaluated according to the following criterion:

| Rank | Area of Sticked Part |
|---|---|
| A | 0-40% |
| B | 41-60% |
| C | 61-80% |
| D | more than 80% |

Each of Samples (1) to (8) was exposed to light emitted by a tungsten lamp covered by a filter (SP-14, manufactured by Fuji Photo Film Co., Ltd.). Therein, exposure amount was 1.6 CHM. The resulting optically exposed samples were devloped for 30 seconds at 35° C.

using the following developing solution, fixed and washed with water.

| Composition of Developing Solution: | |
|---|---|
| Hot water | 800 ml |
| Sodium Tetrapolyphosphate | 2.0 g |
| Anhydrous Sodium Sulfite | 50 g |
| Hydroquinone | 10 g |
| Sodium Carbonate (Monohydrate) | 40 g |
| 1-Phenyl-3-pyrazolidone | 0.3 g |
| Potassium Bromide | 2.0 g |
| Water to make (pH adjusted to 10.2) | 1000 ml |

The thus processed samples was each examined for sensitivity and the extent of fog. Separately, with the intention of evaluating the degree of the influence of the compounds added upon photographic characteristics, each of the optically unexposed samples was kept at 50° C. for 3 days and then it was examined for the change in sensitivity and the fog formation with passage of time.

The results of these samples regarding the static charge preventing ability, the influence on photographic characteristics, and the adhesion resisting property are set forth in Table 1.

TABLE 1

| Sample No. | Antistatic Agent | Static Charge Preventing Ability: Specific Resistance at Surface (Ω) | Static Mark | Capacity (V) | Photographic Properties: Just After Coating Fog | Just After Coating Sensitivity | After Storage Fog | After Storage Sensitivity | Adhesion Resisting Property |
|---|---|---|---|---|---|---|---|---|---|
| 1 | None | $1 \times 10^{14}$ or more | D | +140 | 0.16 | 0 | 0.16 | −0.02 | C |
| 2 | Compound 1 | $5 \times 10^{11}$ | A | +20 | 0.16 | 0 | 0.16 | −0.01 | A |
| 3 | Compound 2 | $9 \times 10^{11}$ | A | +10 | 0.16 | 0 | 0.17 | −0.02 | A |
| 4 | Compound 9 | $7 \times 10^{11}$ | A | +10 | 0.16 | 0 | 0.16 | −0.01 | A |
| 5 | Saponin | $1 \times 10^{14}$ or more | D | +100 | 0.16 | 0 | 0.17 | −0.02 | C |
| 6 | Saccharose Monolauric Acid Ester | $2 \times 10^{13}$ | C | +160 | 0.16 | 0 | 0.17 | −0.02 | C |
| 7 | Polyoxyethylene Nonylphenyl Ether (n=10) | $7 \times 10^{12}$ | B | +90 | 0.16 | −0.1 | 0.21 | −0.17 | D |
| 8 | Polyoxyethylene Lauryl Ether (n=20) | $4 \times 10^{12}$ | B | +100 | 0.15 | −0.15 | 0.24 | −0.25 | D |

The value of sensitivity in Table 1 represents the deviation from the standard sensitivty, which corresponds to the sensitivity of control sample (Sample (1)) just after coating, in a form of the absolute value of log E. Accordingly, the smaller the deviation from the standard sensitivity the smaller the influence upon photographic properties.

As can be seen clearly in Table 1, excellent antistatic effects (namely both specific resistance at the surface and charging capacity are markedly decreased and the occurrence of static marks is hardly observed) are yielded by the addition of the compound of the present invention. In addition, the addition of the compound of the present invention contributes to the improvement in the adhesion resisting property and does not have any adverse influence on photographic characteristics. On the other hand, Samples (7) and (8) in which conventional polyoxyethylene compounds were contained as an antistatic agent for the purpose of comparison are improved in the static charge preventing ability to some extent, but they deteriorate markedly in both photographic properties and the adhesion resisting property. Further, in Samples (5) and (6), which were prepared for the purpose of comparison, the addition of conventional antistatic agents has little influence upon photographic properties, but causes the occurrence of a large quantity of static marks. Thus, the compounds of the present invention are excellent antistatic agents since they do not affect adversely photographic characteristics, and can exhibit excellent static charge preventing and adhesion resisting effects.

EXAMPLE 2

A photographic emulsion prepared by adding the additives, such as the same stabilizer, hardener, coating aid and others used in Example 1 to a high-speed photofluorographic emulsion contaning 7 wt.% of gelatin and 8 wt.% of silver iodobromide grains (containing 1.5 mol% of silver iodide) was coated on one side of polyethylene terephthalate film having a subbing layer provided thereon. To a 1 kg portion of a 2% gelatin aqueous solution, was added 10 ml of a 2% aqueous solution of sodium salt of 2-hydroxy-4,6-dichloro-s-triazine as a hardener. Then, to the resulting solution, was added 2 g of Compound 3 to prepare a surface protecting solution. Separately, 1 g of Compound 3 was added to another 1 kg portion of a 2% gelatin aqueous solution containing 10 ml of a 2% aqueous solution of the same hardener as described above to prepare another surface protecting solution. Each of these solutions was coated on the above-described emulsion layer and dried to make a surface protecting layer. On the other hand, for the purpose of comparison, samples in which protecting layers two different amounts of known polyoxyethylene oleyl ether (n=30) were contained respectively instead of Compound 3 and further in which no antistatic agents was contained were prepared under the same conditions as described above. The thickness of the emulsion layer and that of the protecting layer were 5μ and 1μ, respectively. These photographic film samples were examined for the specific resistance at the surface, the degree of static mark occurrence, the charging capacity and the influence on photographic properties in the same manner as in Example 1. The results obtained are set forth in Table 2.

TABLE 2

| Sample No. | Antistatic Agent | Amount Added* | Static Charge Preventing Ability: Specific Resistance at Surface (Ω) | Static Mark | Capacity (V) | Photographic Properties: Just After Coating: Fog | Senstivity | After Storage: Fog | Sensitivity |
|---|---|---|---|---|---|---|---|---|---|
| 9 | None (Control) | — | $1 \times 10^{14}$ or more | D | +150 | 0.15 | 0 | 0.17 | −0.01 |
| 10 | Compound 3 (Invention) | 2 g | $5 \times 10^{10}$ | A | +5 | 0.15 | 0 | 0.17 | −0.01 |
| 11 | Compound 3 (Invention) | 1 g | $5 \times 10^{11}$ | A | +20 | 0.15 | 0 | 0.16 | 0 |
| 12 | Polyoxyethylene Oleyl Ether (n=30) (Comparison) | 2 g | $8 \times 10^{12}$ | B | +80 | 0.14 | −0.15 | 0.26 | −0.22 |
| 13 | Polyoxyethylene Oleyl Ether (n=30) (Comparison) | 1 g | $1 \times 10^{12}$ | C | +110 | 0.15 | −0.1 | 0.20 | −0.14 |

*g/20 of Solid gelatin

It can be seen clearly from Table 2 that in the samples protected from charging electrostatically by the addition of the compound of the present invention, the specific resistance at the surface and the charging capacity are markedly reduced and the occurrence of static marks is hardly observed. That is to say, excellent antistatic effect can be attained and further, any adverse influence upon photographic characteristics is not detected. In addition, a small amount of addition of the compound of the present invention has proved to be effective for prevention of static troubles.

EXAMPLE 3

Samples (14) to (16) constructed of a backing layer, a cellulose triacetate film support, an emulsion layer and a protecting layer laminated in this order, were prepared through coating and drying processes in a conventional manner. The compositions of respective layers are described below:

(1) Protecting layer:

A layer containing 1.9 g/m$^2$ of gelatin as a binder, 1.5 g per 100 g of binder of 2,3-dihydroxydioxane as a hardener, 20 mg/m$^2$ of silica powder measuring 4$\mu$ in average diameter as a matting agent, and 28 mg/m$^2$ of sodium dodecylbenzenesulfonate as a coating aid.

(2) Emulsion layer:

A layer containing 5 g of silver/m$^2$ of silver iodobromochloride grains (containing 0.1 mol% of silver iodide, 25 mol% of silver bromide and 74.9 mol% of silver chloride), 14 g/m$^2$ of gelatin as a binder, and 0.6 g per 100 g silver of 4-hydroxy-6-methyl-1,3,3a,7-tetraazaindene as an antifoggant.

(3) Backing layer:

A layer containing the combination of 0.5 g/m$^2$ of gelatin and 0.1 g/m$^2$ of cellulose diacetate as a binder, 1.5 g per 100 g binder of glyoxal as a hardener, and 15 mg/m$^2$ of N-lauroyl-N-carboxymethylglycine.sodium salt as a coating aid.

Sample (14) consisted of the above-described compositions alone, and Samples (15) and (16) contained Compound (2) and Compound (6), in their respective backing layers in the amount of 100 mg/m$^2$, in addition to the above-described components.

These samples were examined for their static charge preventing ability in the same manner as in Example 1. The results obtained are shown in Table 3.

TABLE 3

| Sample No. | Antistatic Agent | Static Charge Preventing Ability: Specific Resistance at Surface (Ω) | Degree of Static Mark Occurrence |
|---|---|---|---|
| 14 | None | $1 \times 10^{14}$ or more | D |

TABLE 3-continued

| Sample No. | Antistatic Agent | Static Charge Preventing Ability: Specific Resistance at Surface (Ω) | Degree of Static Mark Occurrence |
|---|---|---|---|
| | (Control) | | |
| 15 | Compound 2 (Invention) | $3 \times 10^{11}$ | A |
| 16 | Compound 6 (Invention) | $9 \times 10^{11}$ | A |

It can be seen from Table 3 that the static charge preventing ability is remarkably improved by the use of the compounds of the present invention.

EXAMPLE 4

Samples (17), (18) and (19), were constructed with a cellulose triacetate film support, an antihalation layer, a red-sensitive silver halide emulsion layer, an interlayer, a green-sensitive silver halide emulsion layer, a yellow filter layer, a blue-sensitive silver halide emulsion layer and a protective layer laminated in order using conventional coating and drying techniques. The compositions of the respective layers described above are illustrated below:

(1) Antihalation layer:

A layer containing 4.4 g/m$^2$ of gelatin as a binder, 5 g per 100 g binder of bis(vinylsulfonylmethyl) ether as a hardener, 4 mg/m$^2$ of sodium dodecylbenzenesulfonate as a coating aid, and 0.4 g/m$^2$ of black colloidal silver as an antihalation component.

(2) Red-sensitive silver halide emulsion layer:

A layer containing 7 g/m$^2$ of gelatin as a binder, 0.7 g per 100 g binder of 2-hydroxy-4,6-dichloro-s-triazine.sodium salt and 2 g per 100 g binder of bis(vinylsulfonylmethyl) ether as a hardener, 10 mg/m$^2$ of sodium dodecylbenzenesulfonate as a coating aid, 3.1 g of silver/m$^2$ of silver iodobromide grains (composed of 2 mol% of silver iodide and 98 mol% of silver bromide), 0.9 g per 100 g silver of 4-hydroxy-6-methyl-1,3,3a,7-tetraazaindene as an antifoggant, 38 g per 100 g silver of 1-hydroxy-4-(2-acetylphenyl)azo-N[4-(2,4-di-tert-amylphenoxy)butyl]-2-naphthoamide as a color forming agent, and 0.3 per 100 g silver of anhydro-5,5'-dichloro-9-ethyl-3,3'-di(3-sulfopropyl)thiacarbocyanine hydroxide.pyridinium salt as a sensitizing dye.

(3) Interlayer:

A layer containing 2.6 g/m$^2$ of gelatin as a binder, 6 g per 100 g binder of bis(vinylsulfonylmethyl) ether as a hardener, and 12 mg/m$^2$ of sodium dodecylbenzenesulfonate as a coating aid.

(4) Green-sensitive silver halide emulsion layer:

A layer containing 6.4 g/m$^2$ of gelatin as a binder, 0.7 g per 100 g binder of 2-hydroxy-4,6-dichloro-s-triazine sodium salt and 2 g per 100 g binder of bis(vinylsulfonylmethyl) ether as a hardener, 9 mg/m$^2$ of sodium dodecylbenzenesulfonate as a coating aid, 2.2 g of silver/m$^2$ of silver iodobromide grains (composed of 3.3 mol% of silver iodide and 96.7 mol% of silver bromide), 0.6 g per 100 g silver of 4-hydroxy-6-methyl-1,3,3a,7-tetraazaindene as a stabilizer, 37 g per 100 g silver of 1-(2,4,6-trichlorophenyl)3-{3[(2,4-di-tert-amylphenoxy)]acetoazido}-4-(4-methoxyphenyl)azo-5-pyrazolone as a color forming agent, and 0.3 g per 100 g of silver of anhydro-5,5'-diphenyl-9-ethyl-3,3'-di(2-sulfoethyl)-oxacarbocyanine hydroxide.pyridinium salt as a sensitizing dye.

(5) Yellow filter layer:

A layer containing 2.3 g/m$^2$ of gelatin as a binder, 0.7 g/m$^2$ of yellow colloidal silver as a filtering component, 5 g per 100 g binder of bis(vinylsulfonylmethyl) ether as a hardener, and 7 mg/m$^2$ of 2-sulfonatosuccinic acid bis(2-ethylhexyl) ester.sodium salt as a surface active agent.

(6) Blue-sensitive silver halide emulsion layer:

A layer containing 7 g/m$^2$ of gelatin as a binder, 0.7 g per 100 g binder of 2-hydroxy-4,6-dichloro-s-triazine.-sodium salt and 2 g per 100 g binder of bis(vinylsulfonylmethyl) ether as a hardener, 8 mg/m$^2$ of sodium dodecylbenzenesulfonate as a coating aid, 2.2 g of silver/m$^2$ of silver iodobromide grains (composed of 3.3 mol% of silver iodide and 96.7 mol% of silver bromide), 0.4 g per 100 g silver of 4-hydroxy-6-methyl-1,3,3a,7-tetraazaindene as a stabilizer, and 45 g per 100 g silver of 2'-chloro-5'-[2-(2,4-di-tert-amylphenoxy)-butyramido]-α-(5,5'-dimethyl-2,4-dioxo-3-oxazolidinyl)-α-(4-methoxybenzoyl)acetoanilide as a color forming agent.

(7) Protecting layer:

A layer containing 2 g/m$^2$ of gelatin and 0.3 g/m$^2$ of styrene-maleic anhydride (1:1) copolymer having an average molecular weight of about 100,000 as a binder, 5 g per 100 g binder of bis(vinylsulfonylmethyl) ether as a hardener, and 5 mg/m$^2$ of sodium dioctylsulfosuccinate as a coating aid.

Sample (17) consisted of the above-described compositions alone, and Samples (18) and (19) contained Compound (1) and polyoxyethylene lauryl ether (n=20), respectively, in amounts of 40 mg/m$^2$ in the protecting layer in addition to the above-described compositions. The specific resistance at the surface of these samples was measured and the occurrence of static marks in each of these samples was evaluated in the same manner as in Example 1 except that each of these samples was color development-processed using the following processing instead of being development-processed using the black-and-white developing solution described in Example 1.

| Step | Temperature | Time |
|---|---|---|
| Color development | 38° C. | 3 min. |
| Bleach | " | 6 min. |
| Washing | " | 3 min. |
| Fixing | " | 6 min. |
| Washing | " | 3 min. |
| Stabilizing | " | 3 min. |

The results obtained are set forth in Table 4.

TABLE 4

| Sample No. | Antistatic Agent | Static Charge Preventing Ability: Specific Resistance at Surface (Ω) | Static Marks | Capacity (V) | Adhesion Resisting Property |
|---|---|---|---|---|---|
| 17 | None (Control) | $1 \times 10^{14}$ or more | D | +180 | C |
| 18 | Compound 1 (Invention) | $8 \times 10^{11}$ | A | +60 | A |
| 19 | Polyoxyethylene Lauryl Ether (n=20) (Comparison) | $9 \times 10^{12}$ | C | +150 | D |

As can be seen clearly from Table 4, the sample in which the compound of the present invention is employed possesses not only excellent adhesion resisting property but also markedly reduced surface resistance and charging capacity and further, static marks are hardly observed therein. Moreover, in the sample (19) containing the comparative compound which was subjected to light-exposure on the basis of ASA No. PH-2-27-1965 and then, to color development in a usual way, desensitization takes place to a great extent in the blue, green and red sensitive silver halide emulsion layers. However, hardly any adverse influence upon photographic properties is noticed in the sample containing the compound of the present invention.

EXAMPLE 5

On one side of a cellulose triacetate film support, was coated the composition containing the following ingredients including Compound 8 of the present invention, and dried for 10 minutes at a temperature of 80° C. to prepare Sample 20. For the purpose of comparison, sample 21 was prepared in the same manner as described above except that the coating composition not containing Compound 8, but composed of the same ingredients, other than Compound 8, was employed, and Sample 22 was also prepared in the same manner as described above except that the comparative compound was used instead of Compound 8. The thickness of the layer coated was about 0.3μ.

| Coating Composition | Weight | | |
|---|---|---|---|
| Ingredient | Sample 20 | Sample 21 | Sample 22 |
| Cellulose Diacetate | 0.2 g | 0.2 g | 0.2 g |
| Water | 10 g | 10 g | 10 g |
| Methanol | 50 g | 50 g | 50 g |
| Acetone | 40 g | 40 g | 40 g |
| Compound 8 | 0.1 g | — | — |

-continued

| Coating Composition | | | |
|---|---|---|---|
| | Weight | | |
| Ingredient | Sample 20 | Sample 21 | Sample 22 |
| Comparative Compound* | — | — | 0.1 g |

*Homopolymer consisting of the repeating unit represented by the following formula:

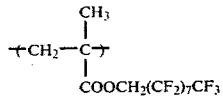

Each of these samples was allowed to stand for 5 hours under air-conditioned circumstances at a temperature of 25° C. and a relative humidity of 60% and then, the specific resistance at the surface of each humidity-conditioned sample was measured under the same air-conditioned circumstances. In sample 20 in which the compound of the present invention was employed, the surface resistance was $3\times10^{10}\Omega$ and such a value is markedly reduced one compared with $1\times10^{13}\Omega$ of surface resistance in the sample 21. On the other hand, the surface resistance of the sample 21 in which the comparative compound was employed was $1\times10^{13}\Omega$.

EXAMPLE 6

Two sheets of the same light sensitive material as prepared in Example 1 were dipped in separate 2 wt% aqueous solutions which contained the compounds set forth in Table 5 respectively for 5 seconds. Then, each of them was dried spontaneously under air-conditioned circumstances at a temperature of 25° C. and a relative humidity of 65%. Next, each of these samples was allowed to stand for 2 hours under air-conditioned circumstances at a temperature of 25° C. and relative humidity of 25% and then, the specific resistance at the surface of each humidity-conditioned sample was measured under the same air-conditioned circumstances. The results obtained are set forth in Table 5.

TABLE 5

| Sample No. | Antistatic Agent | Specific Resistance at Surface (Ω) |
|---|---|---|
| 23 | None (Control) | $1\times10^{13}$ or more |
| 24 | Compound 1 (Invention) | $7\times10^{10}$ |
| 25 | Compound 7 (Invention) | $4\times10^{10}$ |

As can be seen clearly from Table 5, when the compounds of the present invention are coated in a form of aqueous solution on the light sensitive material using a dip-coating technique, they are effective for the purpose of improvement upon the static charge preventing property.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material containing, in at least one layer of copolymer having a repeating unit represented by the following general formula (I):

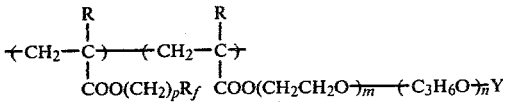

(I)

wherein $R_f$ represents a perfluoroalkyl group having 2 to 12 carbon atoms which may contain one hydrogen atom at the ω-position or a perfluoroalkenyl group; R represents a hydrogen atom or a methyl group; p represents an integer of 1 to 5; m represents an integer of 5 to 50; n represents 0 or an integer of 1 to 20; and Y represents a hydrogen atom, an alkyl group having 1 to 24 carbon atoms, an alkenyl group, a phenyl group, an alkylphenyl group or one of the groups represented by $R_f$.

2. The photographic light-sensitive materialof claim 1, wherein said copolymer is represented by the formula (II)

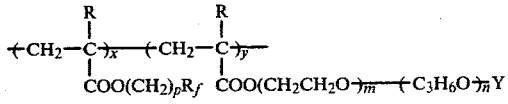

(II)

wherein R, $R_f$, p, m and n are defined as in formula (I) and the ratio of x to y is about 70:30 to about 10:90.

3. The photographic light-sensitive material of claim 2, wherein said copolymer is present in a layer on at least one surface of said photographic light-sensitive material.

4. The photographic light-sensitive material of claim 3, wherein said copolymer is present in a surface protecting layer.

5. The photographic light-sensitive material of claim 3, wherein said copolymer is present in a backing layer.

6. The photographic light-sensitive material of claim 1, wherein said copolymer is present in the material in a coated amount of about 0.005 g/m² to 20 g/m².

7. The photographic light-sensitive material of claim 2, wherein said ratio of x to y is about 50:50 to 20:80.

8. The photographic light-sensitive material of claim 6, wherein said copolymer is present in said material in a coated amount of about 0.01 g/m² to 0.5 g/m².

9. The photographic light-sensitive material of claim 1, wherein said copolymer contains a repeating unit derived from a third comonomer.

* * * * *